US005651327A

United States Patent [19]

Whitener

[11] Patent Number: 5,651,327

[45] Date of Patent: Jul. 29, 1997

[54] DISPLACEMENT, SUBMERGED DISPLACEMENT, AIR CUSHION HYDROFOIL FERRY BOAT

[76] Inventor: Philip C. Whitener, 5595 Battlepoint Dr. NE., Bainbridge Island, Wash. 98110

[21] Appl. No.: 685,022

[22] Filed: Jul. 22, 1996

Related U.S. Application Data

[63] Continuation-in-part of Ser. No. 528,614, Sep. 15, 1995, abandoned.

[51] Int. Cl.[6] ..... B63B 1/00

[52] U.S. Cl. ..... 114/271; 114/67 A; 114/258

[58] Field of Search ..... 114/67 A, 271, 114/278, 258

[56] References Cited

U.S. PATENT DOCUMENTS

| | | | |
|---|---|---|---|
| 3,590,762 | 7/1971 | Yuan | 114/278 |
| 3,968,762 | 7/1976 | Meyer, Jr. | 114/67 A |
| 4,350,107 | 9/1982 | Mattox | 114/67 A |

*Primary Examiner*—Jesus D. Sotelo

*Attorney, Agent, or Firm*—Robert W. Jenny

[57] ABSTRACT

The ferry boat has a rectangular main deck with superstructure above and hull structure below. The superstructure is essentially rectangular in all views and has one or more decks with a plurality of traffic lanes on each deck in addition to those on the main deck. The lanes are straight and parallel and there are no deck-to-deck ramps. The hull structure has two sidewalls, one along each of the long sides of the main deck and two dams, one at each end of the main deck. The dams extend between the sidewalls and have vertical aft surfaces and front surfaces which slope downward and aft. The lower extremities of the sidewalls are further from the main deck than the apexes of the dams. The volume enclosed by the sidewalls, dams, main deck and water surface is filled with entrapped air which will compress to provide a major part of the support of the boat. There are two hydrofoils, one forward, one aft and extending between the sidewalls. Each foil is supported from the deck structure by several struts. The struts and foils have blunt trailing edges ventilated by air ducted down the struts. The foils are submerged about one chord length below the lower edges of the sidewall and the lower edges extend below the apexes of the dams.

2 Claims, 2 Drawing Sheets

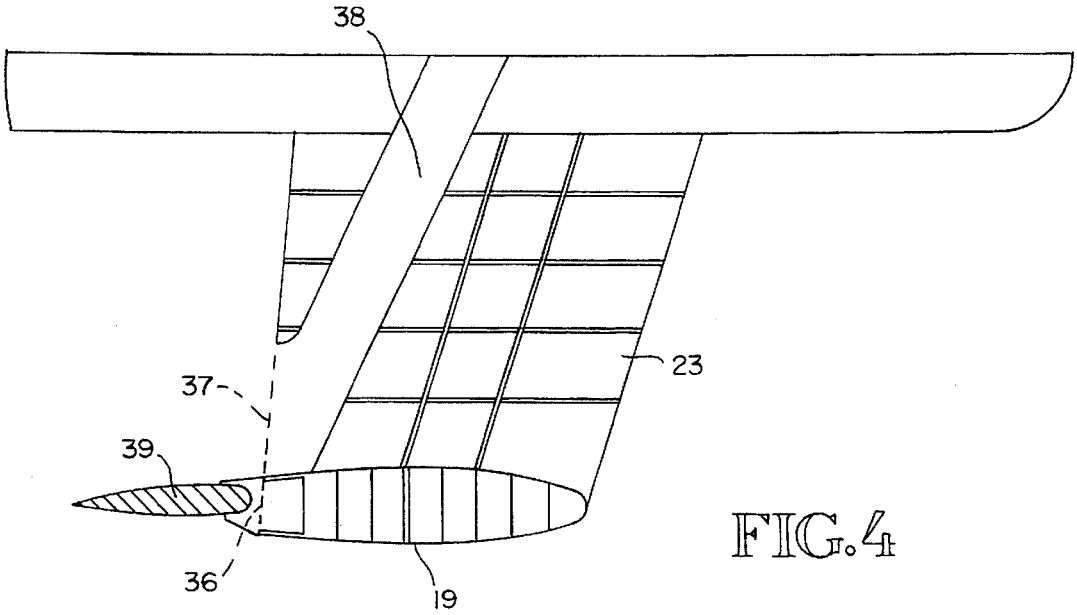
FIG. 4
FIG. 5
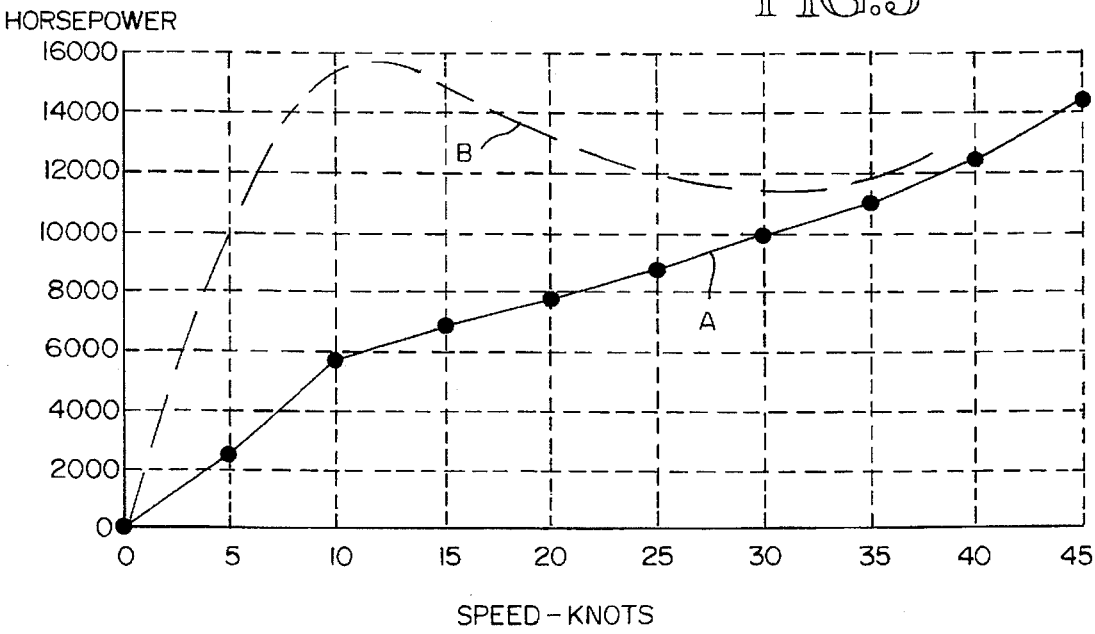

DISPLACEMENT, SUBMERGED DISPLACEMENT, AIR CUSHION HYDROFOIL FERRY BOAT

This application is a Continuation-In-Part application based on application Ser. No. 08/528,614, filed Sep. 15, 1995, now abandoned when this application was duly filed.

BACKGROUND OF THE INVENTION

1. Field

The subject invention is in the fields of vessels intended for ferrying vehicles and passengers and of vessels which derive support from a captured quantity of air known as a bubble, which depend on the displacement provided by a body mounted below the main hull of the vessel on struts and which are equipped with hydrofoils for support and control. It is also in the field of vessels having a plurality of decks having a plurality of lanes for vehicles on each deck.

2. Prior Art

There is well known prior art in all the fields cited above, including ferry boats having multiple decks with a plurality of lanes on each deck. There is no prior art known to the inventor of the subject invention which lies in all of the cited fields.

The patents listed below are a sampling of the prior art:

| U.S. | | |
|---|---|---|
| 1,799,456 | 4,422,517 | |
| 2,672,840 | 4,766,829 | |
| 3,742,888 | 5,146,863 | |
| 4,008,675 | 5,415,120 | |
| 4,227,475 | 60-163788 | Japan |
| 4,196,686 | SU-532-548 | Soviet Union |
| | 895-341 | British |

In metropolitan areas involving islands and related waterways, increasing population generates increasing needs to facilitate traffic flow across the waterways. These needs can be met by building bridges and/or by using and improving ferry systems. Obviously each approach to meeting the increasing needs has its relative advantages and disadvantages. The overall objective of the subject invention is to improve the ratio of advantages to disadvantages for ferry systems, particularly the vessels used in the system, by improving the ratio of traffic flow rate capability of the vessels relative to their sizes as expressed in terms of their displacements. Meeting the overall objective is dependent on meeting other objectives. One such objective is that the vessel be capable of high speed, such as 40 to 50 knots, without creating unacceptable wake and with a low power to weight ratio and good fuel efficiency. Another objective is that the ratio of usable to total deck space be maximized. A third objective is that traffic flow onto, through and off the vessel by virtually free of impediment caused by lane changing and/or use of ramps and ramp adjustment. A fourth objective is that the vessel be economical to construct. Other objectives will become apparent in the following descriptions of the subject invention.

SUMMARY OF THE INVENTION

The subject invention is a ferry boat having a high traffic flow rate capability relative to its size and weight (displacement). For purposes of this disclosure the terminology "traffic flow rate capability" means the number of vehicles the vessel can transport from one terminal to another per unit of time. The subject boat is supported by displacement of water when at rest. Under way it is supported by a combination of an air cushion, displacement provided by strut supported foils, planing of portions of the hull termed dams and the hydrofoil action of the foils.

The boat comprises a rectangular main deck structure. Below the deck structure there is hull structure comprising two sidewalls, each extending from end to end of the deck and positioned along a long edge of the deck structure. Also, the hull structure comprises two elements termed dams for purposes of this disclosure. The dams are parallel to the ends of the boat, one being located near the bow and the other near the stem. Each dam has a vertical aft surface and a forward surface which slopes down and aft from the main deck structure to the lower edge of the aft surface which is the apex of the dam. The sloped surface of each dam is a planing surface which helps lift the hull out of the water and air entrained in the water passing over the surface helps to replenish the air in the cushion (bubble). In operation of the boat the cavity enclosed by the sidewalls, dams, main deck and water surface is filled with trapped air which provides a significant part of the support of the boat. This volume of air is termed a bubble. The lower extremities of the sidewalls are farther from the main deck structure than the apexes of the dams. In an alternate embodiment of the subject invention the dam near the stern may be of flexible construction.

Two hydrofoils are installed on the hull, one forward, one aft. The span of the foils equals or exceeds the width of the deck. They are supported by struts at each end, extending downward from the deck structure and by intermediate struts. The foils are located about one chord length below the lower edges of the sidewalls. The aft (trailing) edges of the foils and struts are blunt and are ventilated by air ducted down the struts and along the trailing edges and the entrained air helps replenish the air in the bubble. Adjustable trailing edge flaps for use at low speeds are stowed in the air cavity behind the foil at high speed. Stability and control are achieved by adjusting the flaps and/or the foils.

When the boat is at rest it is supported by the displacement of the foils, struts and deck structure (hull). At low speeds support is derived from the buoyancy (displacement) of the hull, struts and hydrofoils and the trapped air under the hull, At intermediate speeds the support is derived from the planing surfaces of the dams and hydrodynamic action of the foils, along with lessened support from the air cushion and hull displacement. At cruising speeds most of the hull is clear of the water surface and support is derived by the displacement and hydrodynamic action of the foils along with support derived from dynamic pressurization action of the air cushion.

As the boat gains speed (takes off) most of the drag is produced by the hull and increases approximately with the square of the speed. At all speeds the drag is less with the air cushion than it would be for an equivalent conventional displacement hull. The wave drag of the hull at given speeds is a function of the square of the pressure in the air cushion. As the support from the foils increases with increasing speed, the pressure required in the cushion to maintain equilibrium will decrease, resulting in rapid reduction of wave drag. The adiabatic expansion of the air also reduces the amount of replenishment air required. Friction drag is also reduced as the boat rises out of the water. Increasing speed results in decreasing induced drag of the foils. The result of all these factors is that the "hump drag" experienced with prior art hydrofoil boats and air cushion vessels is largely eliminated. This permits designing the propulsion system by cruise conditions and passenger comfort is enhanced by the relatively effortless take off.

The superstructure may comprise one to three more decks, each having working area essentially equal to that of the main deck. Each of the decks has a plurality of straight parallel lanes and there are no traffic connections between the decks. This arrangement is made feasible by a loading/unloading ramp facility invented by the inventor of the subject invention. The ramp facility enables loading and unloading the subject boat a deck at a time with all lanes on the deck being served emptying or filling simultaneously. This arrangement makes all the working surface of all the decks available for transporting vehicles.

The superstructure is configured to accommodate automobiles, buses, trucks and/or trains as well as walk on passengers. Propulsion is provided by turbine or diesel engines driving varidirectional hydrodynamic thrusters or surface piercing propellers.

The invention is described in more detail below with reference to the attached drawings.

BRIEF DESCRIPTION OF THE DRAWINGS

FIG. 4 is a semi-schematic sectional view taken at 4—4 in FIG. 3.

FIG. 5 is a typical horsepower versus speed curve for the subject boat.

DETAILED DESCRIPTION OF THE INVENTION

Figure 1:
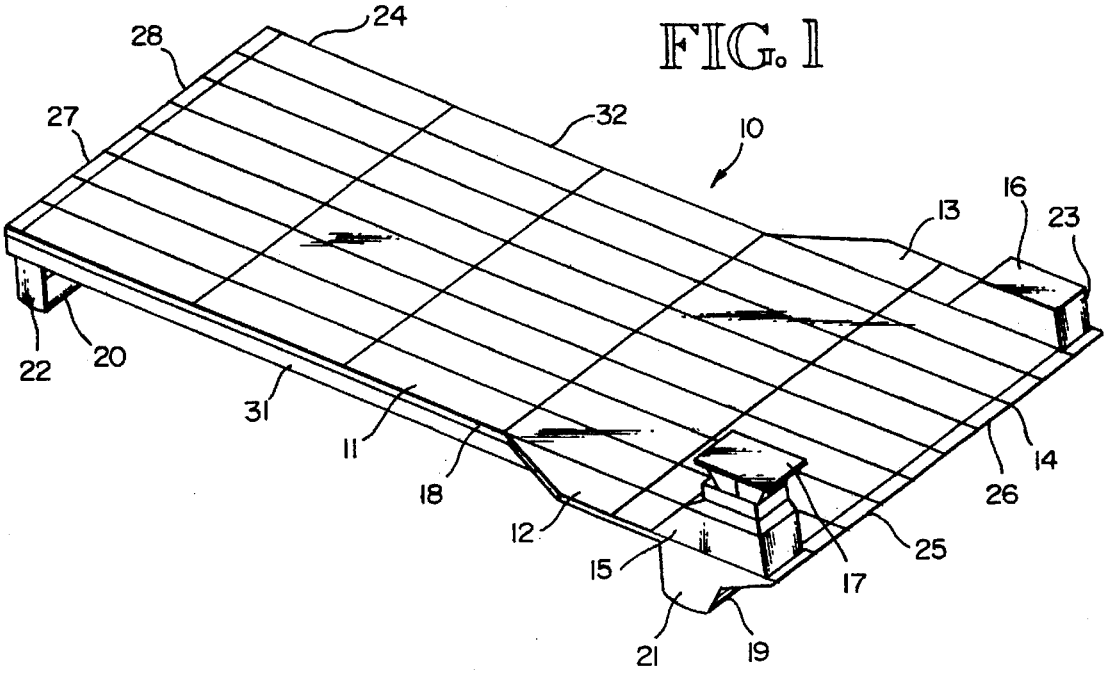
FIG. 1 is a general semi-schematic view of a basic embodiment of the subject invention.

The subject invention is a ferry boat designed to provide a high traffic flow capability relative to its size and displacement. As shown in FIG. 1 the boat 10 has a rectangular basic deck 11 having extended portions 12 and 13 near bow 14. Housings 15 and 16 cover the power plants and control cabin 17 is supported on housing 15. When the boat is at rest it is supported by buoyant displacement of the hull 18 and strut supported hydrofoils 19 and 20 along with the air trapped under the hull (air cushion). The hydrofoils are attached to the hull by struts 21 and 22, similar struts 23 and 24 on the other side of the hull, not visible in this view, and intermediate struts 25, 26, 27 and 28, also not visible in this view. Struts 21, 23, 25 and 26 can be seen in FIG. 3.

Figure 2:
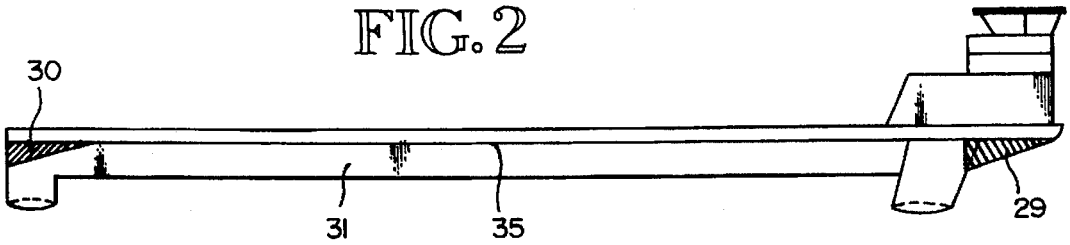
FIG. 2 is a general semi-schematic side view of the embodiment of FIG. 1.

FIG. 2 is a semi-schematic side view of boat 10. The shaded areas show the cross section size, shape and location of dams 29 and 30 which extend the full width of the hull between sidewall 31 and sidewall 32, not visible in this view but shown in FIG. 3. In an alternate embodiment of the subject invention dam 30 may be of flexible construction.

Figure 3:
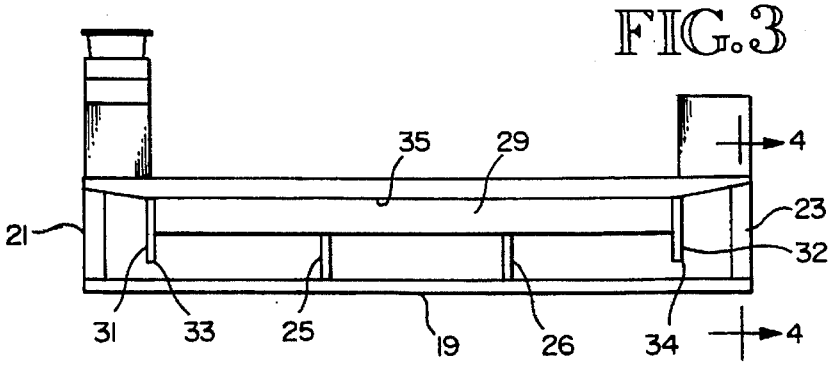
FIG. 3 is an end view of the embodiment shown in FIG. 1.

FIG. 3 is a view of the boat from the bow. Struts 21, 23, 25 and 26, dam 29, foil 19 and sidewalls 31 and 32 are visible. As shown, foil 19 may extend beyond the sidewalls under extended portions 12 and 13. When the boat is under way the lower edges 33 and 34 of the sidewalls are immersed in the water, the boat planes on the dams and a quantity of air termed a bubble is enclosed in a cavity bounded by the water surface, the dams, the sidewalls and underside 35 of the deck.

FIG. 4, a semi-schematic sectional view taken at 4—4 in FIG. 3, shows details of the hydrofoils and their installation. Trailing edge 36 of foil 19 and trailing edge 37 of strut 23 are blunt and ventilated by air provided through duct(s) 38. Without ventilation, the base pressure will approach the vapor pressure of water. This low pressure will cause air in duct 38 to flow into the base cavity. Engine exhaust gasses may also be introduced into the duct to augment the flow. This air will be entrained in the high speed water at the air/water boundary and released into the air cushion at a pressure approaching the dynamic pressure of the water. The trailing edges may be open, perforated of some combination of the two and air exiting the trailing edges of the forward foil and struts helps fill the bubble. Trailing edge flaps such as flap 39 may be provided for use at low speeds. The flaps may be stowed in the foil base air cavity at higher speeds. Stability and control are achieved by adjusting the flaps and/or the foils.

FIG. 5 is a plot of horsepower required versus speed. Curve A relates to the subject boat and curve B generally illustrates the power required for pure hydrofoil vessels and for air cushion vessels. As shown, curve A is almost linear whereas curve B illustrates that hydrofoil and air cushion craft require as much or more power during the transition from idle to cruise conditions as for cruise conditions. These curves illustrate that the interactions of the hydrofoils, planing surfaces and air cushion action and pressure make the subject boat comparatively significantly less costly to operate than other vessels able to cruise at speeds in the 40 to 50 knot range. This is particularly true for ferry boat operation in which the trips are short and frequent, requiring frequent transition between at rest and cruise conditions.

In a preferred embodiment the boat is propelled by surface piercing propellers which can be raised and lowered to suit operating conditions. Thrust reversing panels may be used to help decelerate the boat.

It is considered to be within the capabilities of persons having ordinary skill in the art to provide details of design required for construction of the subject boat and not provided in this disclosure.

It is also considered to be understandable from this disclosure that the subject invention meets its objectives. It provides a ferry boat having a high ratio of traffic flow rate capability to its displacement. The boat is capable of speeds in a range of 40 to 50 knots without creating unacceptable wakes and with a low power to weight ratio and good fuel efficiency. Virtually all the deck space is usable for handling traffic onto, through and off the boat. There is no impediment to traffic flow caused by use of ramps, ramp adjustments or lane changes. The boat structure is simple and economical, comprising primarily flat surfaces and being highly suitable for modular construction using prefabricated units of structure.

It is also considered to be understood that embodiments of the invention other than the one described or modifications of the one described are possible within the scope of the subject invention which is limited only by the attached claims.

I claim:

1. A boat operable on a water surface and comprising:

a rectangular main deck structure having a bow, a stem, a first side and a second side and means for propelling said boat, said boat further comprising:

a first sidewall having a first lower edge and a second sidewall having a second lower edge and a first dam and a second dam, said first and second sidewalls each extending from said bow to said stern, said first sidewall being attached to said main deck structure along said first side, said second sidewall being attached to said main deck structure along said second side, said first and second lower edges each being at a first distance from said main deck structure, said first dam extending from said first sidewall to said second sidewall and being attached to said main deck structure near said bow, said second dam extending from said first sidewall to said second sidewall and being attached to said main deck structure near said stern, thereby forming a cavity enclosed by said first and second sidewalls, said first and second dams, said main deck structure and said water surface, said boat further comprising means for providing air to said cavity, at least one of said dams having an aft surface, a forward surface and an apex, said aft surface being essentially vertical and having a lower edge, said lower edge being the apex of said dam, said forward surface sloping aft and downward from said main deck structure to said apex, said apex of said at least one dam being a second distance from said main deck structure, said first distance being greater than said second distance, said boat further comprising:

a first hydrofoil and a second hydrofoil, said first hydrofoil extending at least from said first sidewall to said second sidewall near said bow and being supported on a first plurality of struts from said main deck structure at a third distance from said main deck structure, said second hydrofoil extending from said first sidewall to said second sidewall near said stern and being supported on a second plurality of struts from said main deck structure at a fourth distance, said third and fourth distances being greater than said first distance.

2. The boat of claim 1 in which at least one of said hydrofoils and at least one of said struts of said first and second pluralities of struts has a blunt trailing edge, said boat further comprising means for providing ventilating air to said blunt trailing edge of said at least one hydrofoil and to said blunt trailing edge of said at least one strut, said ventilating air being introduced into said cavity to supplement provision of air to said cavity.

* * * * *

UNITED STATES PATENT AND TRADEMARK OFFICE

CERTIFICATE OF CORRECTION

PATENT NO. : 5,651,327
DATED : July 29, 1997
INVENTOR(S) : P.C. Whitener

It is certified that error appears in the above-indentified patent and that said Letters Patent is hereby corrected as shown below:

| COLUMN | LINE | |
|---|---|---|
| Pg. 1, col. 1 | Primary Examiner | "Jesus D. Sotelo" should read --Jesús D. Sotelo-- |
| 4 | 58 | "a bow, a stem" should read --a bow, a stern-- |

Signed and Sealed this

Sixteenth Day of December, 1997

*Attest:*

*Attesting Officer*

BRUCE LEHMAN

*Commissioner of Patents and Trademarks*